US006680708B2

(12) United States Patent
Yamaki

(10) Patent No.: US 6,680,708 B2
(45) Date of Patent: Jan. 20, 2004

(54) LOOP ANTENNA, SURFACE-MOUNTED ANTENNA AND COMMUNICATION EQUIPMENT HAVING THE SAME

(75) Inventor: Kazuhisa Yamaki, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/269,121

(22) Filed: Oct. 12, 2002

(65) Prior Publication Data

US 2003/0071757 A1 Apr. 17, 2003

(30) Foreign Application Priority Data

Oct. 12, 2001 (JP) ..... 2001-315567

(51) Int. Cl.[7] ..... H01Q 11/12; H01Q 7/00
(52) U.S. Cl. ..... 343/741; 343/866; 343/702
(58) Field of Search ..... 343/741, 866, 343/702, 700 MS, 742, 867

(56) References Cited

U.S. PATENT DOCUMENTS 5,583,523 A * 12/1996 Wallace, Jr. ..... 343/741

* cited by examiner

*Primary Examiner*—Hoang V. Nguyen
(74) *Attorney, Agent, or Firm*—Keating & Bennett, LLP

(57) ABSTRACT

In order to enable one radiant electrode to transmit and receive signals with a plurality of frequency bands, in a base member, a feeding electrode to be connected to a signal supply source and an open electrode floated from the ground are arranged adjacent to each other leaving a space. In the base member, one end of a linear electrode is connected to the feeding electrode while the other end is connected to the open electrode. A substantially loop-shaped radiant electrode extending from the feeding electrode toward the open electrode via the linear electrode is defined by the feeding electrode, the open electrode, and the linear electrode. The linear electrode is provided with a short-cut electrode short-cutting a loop of the radiant electrode. A feeding-end portion (feeding electrode) and an open-end portion (open electrode) of the loop-shaped radiant electrode are combined together with a capacitance therebetween, so that the gain in an antenna operation due to higher-order resonance of the radiant electrode is improved, enabling not only basic resonance of the radiant electrode but also the higher-order resonance to be practically used in signal transmitting or receiving.

19 Claims, 6 Drawing Sheets

LOOP ANTENNA, SURFACE-MOUNTED ANTENNA AND COMMUNICATION EQUIPMENT HAVING THE SAME

BACKGROUND OF THE INVENTION

1. Field of the Invention

The present invention relates to a loop-shaped antenna and a surface-mounted antenna to be mounted on a circuit board of communication equipment, for example, and the communication equipment having such an antenna.

2. Description of the Related Art

A conventional antenna of this type includes a plurality of radiant electrodes. Each of the radiant electrodes has a resonance frequency band that is different from each other so as to transmit or receive each of a plurality of signals having different resonance frequency bands. As a result, one antenna having a plurality of radiant electrodes can transmit or receive signals with a plurality of frequency bands.

However, in such an antenna, miniaturizing of the antenna is difficult because of the need to have a plurality of radiant electrodes.

FIG. 6 is a schematic perspective view of an example of a surface-mounted antenna. In a surface-mounted antenna 20, a base member 21 made of a dielectric substance is provided with a feeding radiant electrode 22 arranged to extend from a bottom surface 21*a* toward a side surface 21*d* via a side surface 21*b* and a top surface 21*c*. A metallic plate 24 is attached to the base member 21 with one end connected to the feeding radiant electrode 22. The other end of the metallic plate 24 is an open end. In the surface-mounted antenna 20, one radiant electrode is defined by the feeding radiant electrode 22 and the metallic plate 24.

Such a surface-mounted antenna 20 is connected on a substrate 25 of an object to be mounted (a circuit board of communication equipment, for example) by soldering using the bottom surface 21*a* of the base member 21 as a mounting surface. The base member 21 is provided with a fixing electrode 23, which is to be a base electrode for soldering. The fixing electrode 26 may be grounded or may not be grounded on the substrate 25 of the object to be mounted (mounting substrate) depending on a circuit of the mounting substrate 25.

The feeding radiant electrode 22 is connected to a signal supply source 27 via a matching circuit 26 by mounting the surface-mounted antenna 20 on the mounting substrate 25 exactly as designed. Supplying a signal from the signal supply source 27 to the feeding radiant electrode 22 via the matching circuit 26 transmits the signal to the metallic plate 24 via the feeding radiant electrode 22. By the signal supply, the feeding radiant electrode 22 and the metallic plate 24 produce resonance so as to perform an antenna operation (that is, transmitting or receiving of a signal).

As noted above, the radiant electrode has a plurality of resonant frequencies that are different from each other so as to be able to produce resonance at each of the frequencies. Accordingly, in order to make an antenna applicable to a plurality of communication systems, it is under consideration that one radiant electrode is made to perform a higher-order-mode antenna operation with a frequency higher than that of a basic-mode as well as perform the basic-mode antenna operation (that is, operation of transmitting or receiving of a signal), by utilizing not only the resonance with the basic lowest resonance frequency of the radiant electrode but also the resonance with a higher-order-mode resonance frequency higher than that.

However, in the structure of the surface-mounted antenna 20, it has been difficult to satisfactorily perform the higher-order mode antenna operation because of insufficiency in a gain.

Since the mounting substrate is assumed to be a grounded plane, in the structure of the surface-mounted antenna 20, an unnecessary capacitance is produced between the metallic plate 24 and the mounting substrate 25. There is a problem that the antenna gain is liable to deteriorate because of the unnecessary capacitance between the metallic plate 24 and the mounting substrate 25.

SUMMARY OF THE INVENTION

In order to solve the above-described problems, preferred embodiments of the present invention provide a miniaturized loop antenna having only one radiant electrode that is capable of transmitting or receiving signals with a plurality of frequency bands that are different from each other so as to perform a basic-order-mode antenna operation and a higher-order-mode antenna operation and a communication apparatus including such a novel antenna.

According to one preferred embodiment of the present invention, a loop antenna includes a linear radiant electrode for performing an antenna operation, one end of the radiant electrode being a feeding end for receiving a signal from a signal supply source and the other end being an open end, wherein the radiant electrode has a substantially loop shape, in which a feeding-end portion and an open-end portion are arranged adjacent to each other with a spaced defined therebetween, and wherein the radiant electrode is provided with a short-cut electrode short-cutting a loop of the radiant electrode.

Preferably, the loop of the radiant electrode extending from the feeding end toward the open end has an electrical length corresponding to a predetermined basic-mode resonance frequency while a short loop extending from the feeding end of the radiant electrode toward the open end via the short-cut electrode has an electrical length corresponding to a higher-order-mode resonance frequency higher than the basic-mode resonance frequency, such that the radiant electrode performs a basic-mode antenna operation and a higher-order-mode antenna operation.

Preferably, the radiant electrode is narrow plate-shaped instead of being linear shaped.

According to this preferred embodiment of the present invention, the wire or narrow plate-shaped radiant electrode is formed to have a substantially loop shape by arranging a feeding-end portion and an open-end portion adjacent to each other with a space provided therebetween. The radiant electrode is provided with the short-cut electrode short-cutting the loop of the radiant electrode. The loop extending from the feeding end of the radiant electrode toward the open end has an electrical length corresponding to the established basic-mode resonance frequency while the short loop extending from the feeding end of the radiant electrode toward the open end via the short-cut electrode has an electrical length corresponding to the established higher-order-mode resonance frequency, so that the radiant electrode can perform predetermined basic-mode and higher-order-mode antenna operations.

That is, signals with predetermined plural frequency bands can be transmitted or received by providing only one radiant electrode, so that the miniaturizing of the antennal can be facilitated in comparison with an antenna having plural radiant electrodes.

In the loop antenna according to this preferred embodiment of the present invention, an electrical length of the loop (basic loop) extending from the feeding end of the radiant electrode toward the open end determines the basic-mode resonance frequency of the radiant electrode while the short loop extending from the feeding end of the radiant electrode toward the open end via the short-cut electrode determines the higher-order-mode resonance frequency of the radiant electrode. The electrical length of the short loop can be changed and set by adjusting the arrangement and length of the short-cut electrode independently of the electrical length of the basic loop. That is, the electrical length of the basic loop and the electrical length of the short loop can be changed and set separately from each other. Therefore, the basic-mode resonance frequency of the radiant electrode and the higher-order-mode resonance frequency can be adjusted and set to independently have the respective established frequencies. Thereby, the design of the radiant electrode is extremely flexible and easy so as to easily allow for and accommodate many design changes.

In contrast, in a conventional antenna, when the radiant electrode is to perform an antenna operation by using higher-order-mode resonance frequencies other than the lowest resonance frequency among the plural resonance frequencies of the radiant electrode, it is very difficult to use the higher-order-mode antenna operation because the gain in the higher-order-mode antenna operation is extremely small.

Whereas, according to the present preferred embodiment of the present invention, the feeding-end portion and the open-end portion of the radiant electrode are arranged adjacent to each other with a space defined therebetween, so that the feeding-end portion and the open-end portion are combined with a capacitance therebetween. By the capacitance combination, the gain in the higher-order mode is greatly improved so as to achieve the using the higher-order-mode resonance frequency of the radiant electrode to the signal transmission or receiving.

Furthermore, according to the present preferred embodiment of the present invention, the feeding-end portion and the open-end portion of the radiant electrode are combined with a capacitance therebetween, so that an electric field can be confined within the loop of the radiant electrode. As a result, reduction in the frequency bandwidth and the deterioration in the gain due to the electric field captured to the ground is reliably prevented. In particular, such reduction in the frequency bandwidth and deterioration in the gain are liable to occur in the higher-order-mode side. However, by the electric field confining effect due to the loop shape of the radiant electrode, these problems are prevented from occurring.

According to another preferred embodiment of the present invention, a surface-mounted antenna includes a base member having a feeding electrode to be connected to a signal supply source, an open electrode arranged substantially parallel to the feeding electrode leaving a space in a floated state from the ground, and a linear electrode attached to the base member with one end connected to the feeding electrode and with the other end connected to the open electrode, wherein a loop-shaped radiant electrode extending from the feeding electrode toward the open electrode via the linear electrode is defined by the feeding electrode, the linear electrode, and the open electrode, and wherein the linear electrode is provided with a short-cut electrode for short-cutting a loop of the radiant electrode.

Preferably, the loop of the radiant electrode extending from the feeding electrode toward the open electrode via the linear electrode has an electrical length corresponding to a predetermined basic-mode resonance frequency and a short loop extending from the feeding electrode of the radiant electrode toward the open electrode via the linear electrode and the short-cut electrode has an electrical length corresponding to a predetermined high-order-mode resonance frequency higher than the basic-mode resonance frequency so that the radiant electrode performs a basic-mode antenna operation and a higher-order-mode antenna operation.

Preferably, the base member is provided with a frequency-adjusting electrode arranged adjacent to one of the feeding electrode and the open electrode leaving a space for adjusting the resonance frequency of the radiant electrode by being combined with the adjacent electrode with a capacitance therebetween.

Preferably, the base member is provided with a narrow plate-like electrode instead of the linear electrode.

According to the present preferred embodiment of the present invention, the substantially loop-shaped radiant electrode extending from the feeding electrode toward the open electrode via the linear electrode is configured by the feeding electrode and the open electrode, which are disposed in the base member, and the linear electrode attached to the base member. The feeding electrode and the open electrode are arranged adjacent to each other leaving a space, so that the feeding electrode and the open electrode are combined with a capacitance therebetween. In other words, the substantially loop-shaped radiant electrode is arranged such so that a feeding-end portion (feeding electrode) and an open-end portion (open electrode) are combined with a capacitance therebetween.

By this configuration, the gain in the higher-order-mode antenna operation of the radiant electrode is greatly improved. That is, not only the resonance at the basic-mode resonance frequency of the radiant electrode but also the resonance at the higher-order-mode resonance frequency can be sufficiently utilized as antenna operations. Thereby, signals with a plurality of different frequency bands can be transmitted or received by only one radiant electrode.

Also, according to the present preferred embodiment of the present invention, the linear electrode is provided with the short-cut electrode short-cutting the loop of the radiant electrode. By providing the short-cut electrode, the radiant electrode has the short loop extending from the feeding electrode toward the open electrode via the linear electrode and the short-cut electrode. By configuring the short loop of the radiant electrode to have an electrical length corresponding to the established higher-order-mode resonance frequency and by configuring the basic loop of the radiant electrode extending from the feeding electrode toward the open electrode via the linear electrode to have an electrical length corresponding to the established basic-mode resonance frequency, the radiant electrode can perform predetermined basic-mode and higher-order-mode antenna operations.

The basic-mode resonance frequency of the radiant electrode is determined by the electrical length of the basic loop while the higher-order-mode resonance frequency is determined by the electrical length of the short loop. By changing the arrangement and length of the short-cut electrode, the electrical length of the short loop can be changed, whereas the electrical length of the basic loop is not changed. Therefore, by changing the arrangement and length of the short-cut electrode, the higher-order-mode resonance frequency of the radiant electrode can be changed independently of the basic-mode resonance frequency. Thereby, the resonance frequencies of the basic mode and higher-order-mode of the radiant electrode can be easily changed and adjusted so as to promptly correspond to the design change, for example. Also, by providing the frequency-adjusting electrode in the base member, the adjustable range of the resonance frequency of the radiant electrode can be expanded.

Furthermore, according to the present preferred embodiment of the present invention, the feeding electrode (feeding-end portion) and the open electrode (open-end portion) of the radiant electrode are combined with a capacitance therebetween, so that an electric field can be confined within the loop of the radiant electrode. Thereby, reduction in the frequency bandwidth and the deterioration in the gain due to the electric field captured to the ground are reliably prevented. In particular, such reduction in the frequency bandwidth and deterioration in the gain are liable to occur in the higher-order-mode side. However, by the confining effect of the electric field due to the loop shape of the radiant electrode, these problems are reliably prevented from occurring.

Furthermore, in the narrow plate-shaped electrode changed from the wire electrode, the narrow plate-shaped electrode is manufactured preferably by punching a metallic plate using a die. In this case, the narrow plate-shaped electrode can be easily manufactured, thereby improving the productivity of the electrode.

Moreover, the electrodes attached to the base member have unnecessary capacitances to a substrate to be mounted, which is assumed as the ground. However, according to a preferred embodiment of the present invention, the electrodes attached to the base member have wire or narrow plate shapes, and thus the unnecessary capacitances to the ground are minimized. Thereby, the deterioration in the antenna gain due to the unnecessary capacitances between the electrode and the ground are prevented.

In another preferred embodiment, a communication apparatus includes one of the antennae according to the preferred embodiments described above.

In a communication apparatus having an antenna according to preferred embodiments of the present invention, by the miniaturized antenna, the communication apparatus can be easily miniaturized. The reliability of the communication apparatus is also greatly improved.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Preferred embodiments according to the present invention will be described below with reference to the drawings.

Figure 1:
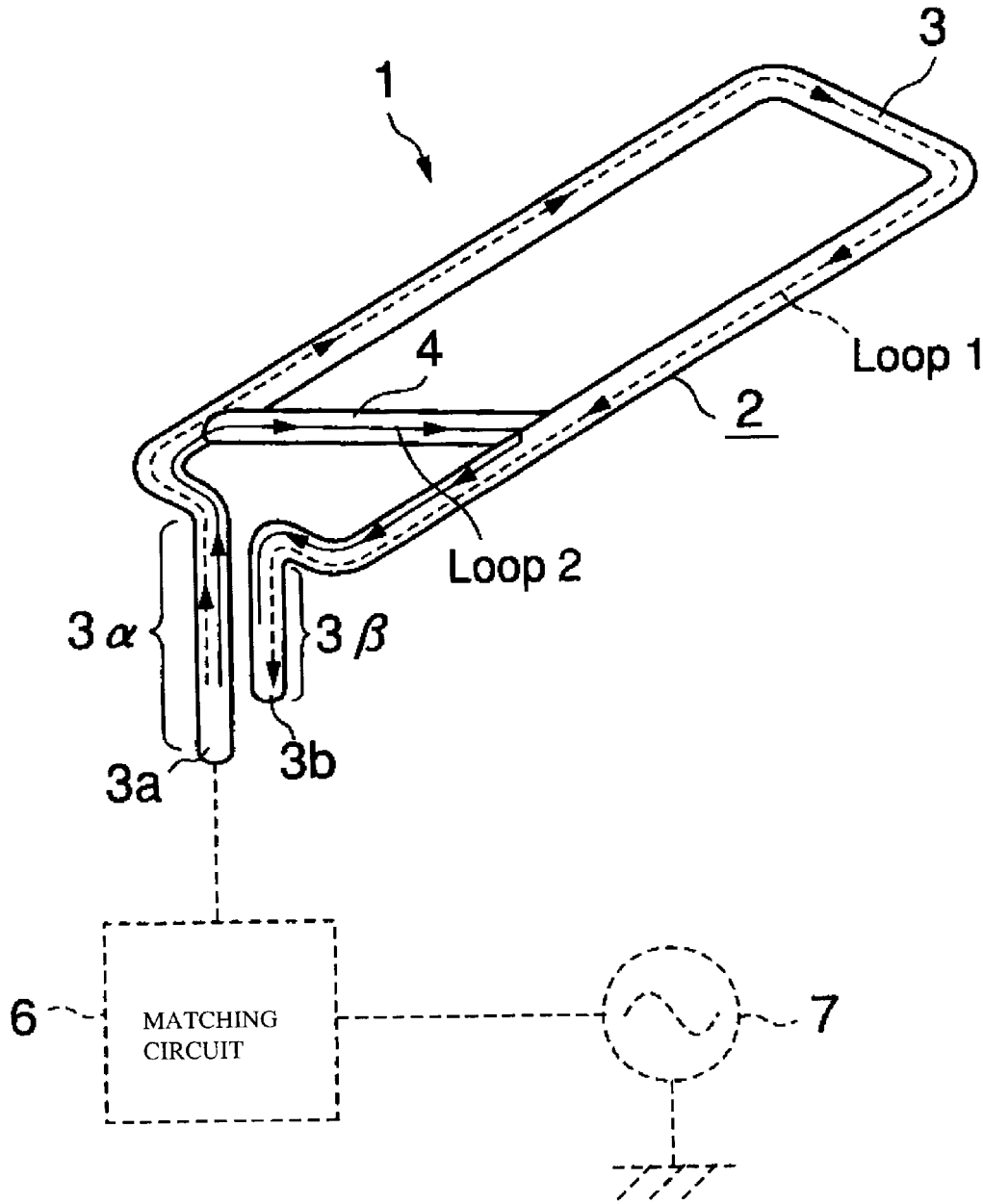
FIG. 1 is a model view of a loop antenna according to a preferred embodiment of the present invention.

FIG. 1 is a schematic perspective view of an example of a loop antenna according to a preferred embodiment that is specific to communication equipment. The communication equipment has various structures, and any structure thereof other than the antenna may be applicable to preferred embodiments of the present invention, so that the description of the structure of the communication equipment other than the antenna is omitted here.

A characteristic loop antenna 1 according to the preferred embodiment includes a radiant electrode 2 preferably made of metallic wire. The radiant electrode 2 includes a loop electrode 3 and a short-cut electrode 4. The loop electrode 3 is substantially loop-shaped with one-end portion 3α and the other-end portion 3β arranged adjacent to each other with a space provided therebetween. One end 3*a* of the loop electrode 3 is a feeding end, which is connected to a signal supply source 7 with a matching circuit 6 therebetween disposed on a circuit board of communication equipment, for example. The other end 3*b* of the loop electrode 3 is an open end.

According to the present preferred embodiment, the feeding-end portion 3α and the open-end portion 3β are arranged adjacent to each other with a space provided therebetween, so that a capacitance is produced between the feeding-end portion 3α and the open-end portion 3β, thereby combining the feeding-end portion 3α and the open-end portion 3β together.

According to the preferred embodiment, a loop (basic loop) Loop 1 has an electrical length extending from the feeding end 3*a* of the loop electrode 3 toward the open end 3*b* for having a predetermined basic-mode resonance frequency f1.

The short-cut electrode 4 is arranged so as to short-cut the loop of the loop electrode 3. By the short-cut electrode 4, a short loop, Loop 2, is provided, which extends from the feeding end 3*a* of the loop electrode 3 toward the open end 3*b* via the short-cut electrode 4. According to the present preferred embodiment, a higher-order-mode resonance frequency f2 that is higher than the basic-mode resonance frequency f1 is predetermined. The arrangement of the short-cut electrode 4 relative to the loop electrode 3 and the length of the short-cut electrode 4 are set so that the short loop, Loop 2, has an electrical length for obtaining a predetermined higher-order-mode resonance frequency f2. In addition, the short-cut electrode 4 may be made of the same material as that of the loop electrode 3 or a different material from that.

In the loop antenna 1 according to the present preferred embodiment, when a signal with the basic-mode resonance frequency f1 is supplied from the signal supply source 7 to the feeding end 3*a* of the loop electrode 3 via the matching circuit 6, a major portion of the signal turns on electricity toward the open end 3*b* via the route of the basic loop, Loop 1. Thereby, the loop electrode 3 resonates at the basic-mode resonance frequency f1, so that the radiant electrode 2 performs the basic-mode antenna operation (that is, operation of transmitting or receiving of a signal).

When a signal with the higher-order mode resonance frequency f2 is supplied from the signal supply source 7 to the feeding end 3*a* of the loop electrode 3, a major portion of the signal turns on electricity toward the open end 3*b* via the route of the short loop, Loop 2. Thereby, the loop electrode 3 and short-cut electrode 4 resonate at the higher-order mode resonance frequency f2, so that the radiant electrode 2 performs the higher-order mode antenna operation.

Meanwhile, the capacitance between the feeding-end portion 3α and the open-end portion 3β of the loop electrode 3 is largely involved in the gain of the higher-order-mode antenna operation. Therefore, according to the present preferred embodiment, the space between the feeding-end portion 3α and the open-end portion 3β of the loop electrode 3 is appropriately adjusted so as to improve the higher-order-mode gain. As adjusting techniques, the capacitance between the feeding-end portion 3α and the open-end portion 3β can be adjusted by adjusting the length of portions such that the feeding-end portion 3α and the open-end portion 3β of the loop electrode 3 are arranged in parallel with each other, or adjusting the space between portions such that the feeding-end portion 3α and the open-end portion 3β are arranged in parallel with each other.

Figure 2:
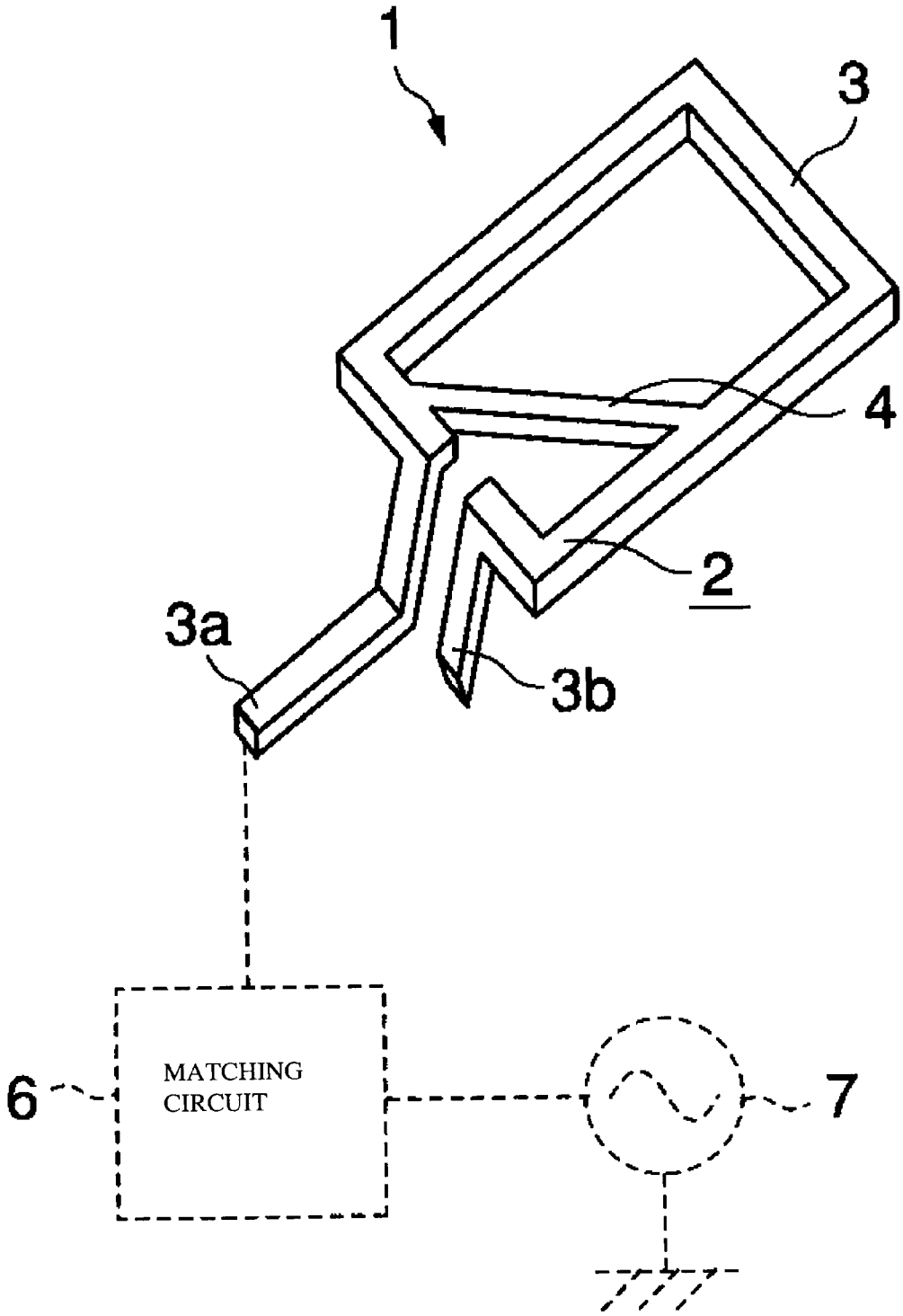
FIG. 2 is a model view of a loop antenna according to another preferred embodiment of the present invention.

Various modifications of the present preferred embodiment of the present invention may be made within the scope of the present invention. For example, the loop electrode 3 and short-cut electrode 4 of the radiant electrode 2 may be made of a narrow metallic plate as shown in FIG. 2. In this case, the radiant electrode 2 is easily manufactured by punching a metallic plate using a die, so that the productivity can be improved.

Also, one of the loop electrode 3 and the short-cut electrode 4 may be made of metallic wire while the other may be made of a narrow metallic plate. Furthermore, the loop electrode 3 and the short-cut electrode 4 may be made by forming a conductive member on the surface of a base member such as a dielectric member having a shape that is similar to that of the radiant electrode 2 according to the present preferred embodiment.

The feeding end 3*a* of the radiant electrode 2 is connected to the signal supply source 7 via the matching circuit 6 according to the present preferred embodiment. However, the matching circuit 6 may be omitted if the impedance in the radiant electrode 2 is matched with the impedance in the signal supply source 7.

Furthermore, the loop electrode 3 of the radiant electrode 2 is preferably substantially rectangular loop-shaped as shown in FIGS. 1 and 2. Alternatively, it may be substantially circular loop-shaped, substantially triangular loop-shaped, or substantially polygonal, more than pentagonal, loop-shaped, or other suitable shape. That is the shape of the loop electrode 3 is not particularly limited.

Also, one short-cut electrode 4 is preferably provided according to the present preferred embodiment. Alternatively, a plurality of short-cut electrodes 4 may be provided. Thereby, the radiant electrode 2 can perform the antenna operation applicable to three or more frequency bands.

Figure 3:
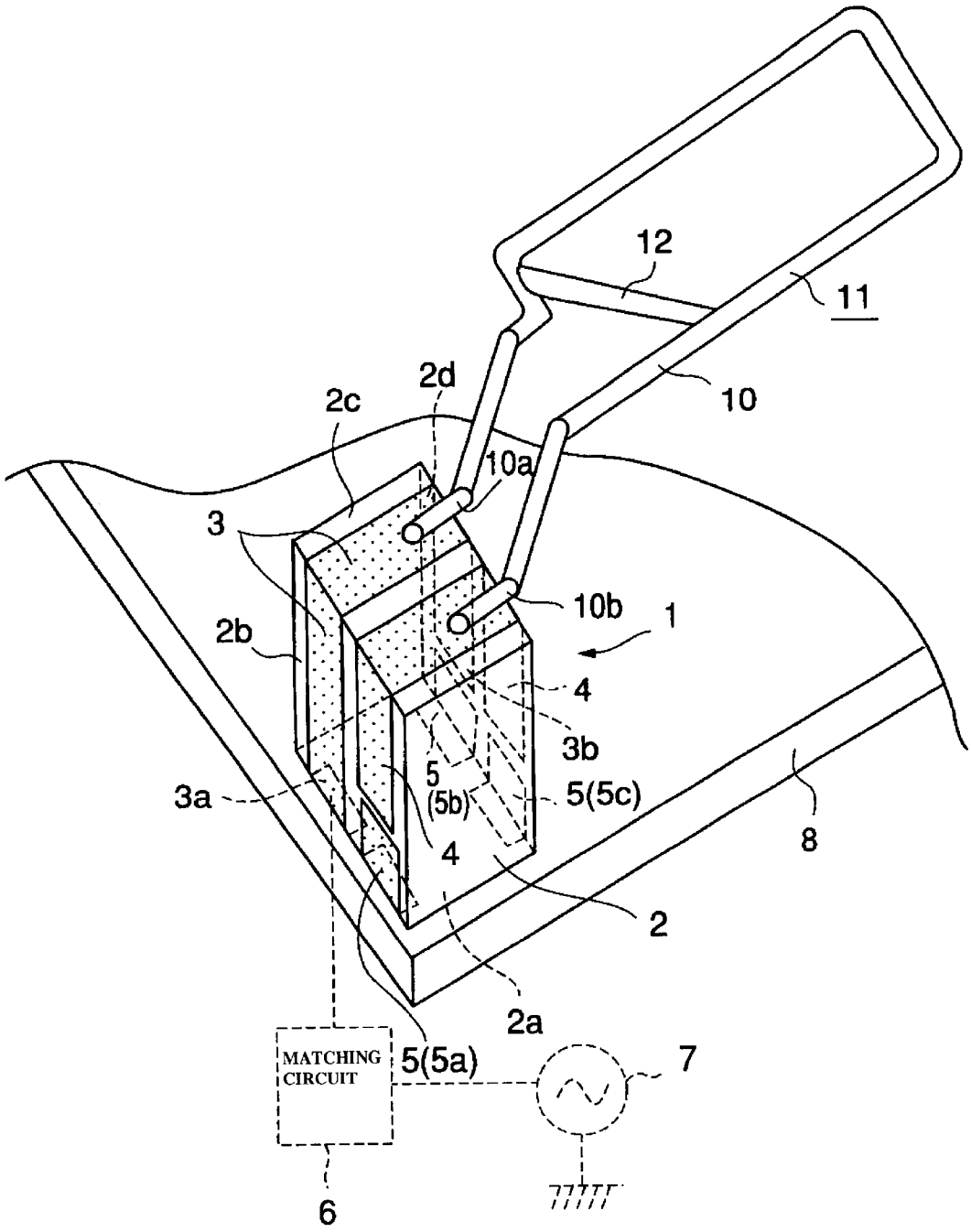
FIG. 3 is a schematic perspective view of a surface-mounted antenna according to a further preferred embodiment of the present invention.

Another preferred embodiment is shown in FIG. 3, which is a schematic perspective view of an example of a surface-mounted antenna specific to communication equipment. As noted above, the communication equipment has various structures, and any structure thereof other than the antenna may be applicable to preferred embodiments of the present invention, so that the description of the structure of the communication equipment other than the antenna is omitted here.

A surface-mounted antenna 100 according to the present preferred embodiment includes a base member 200 made of a dielectric material. The base member 200 includes a feeding electrode 300, an open electrode 400, and fixing electrodes 500 (500*a*, 500*b*, and 500*c*) disposed therein.

According to the present preferred embodiment, the feeding electrode 300 is arranged to extend from a bottom surface 200*a* of the base member 200 toward a side surface 200*d* via a side surface 200*b* and a top surface 200*c*. One end of the feeding electrode 300 is a feeding end 300*a*, which is connected to a signal supply source 700 via a matching circuit 600 disposed on a circuit board of communication equipment, for example. The other end 300*b* of the feeding electrode 300 is an open end.

According to the present preferred embodiment, the open electrode 400 is arranged substantially parallel with the feeding electrode 300 with a space provided therebetween so as to extend from the side surface 200*b* of the base member 200 toward the side surface 200*d* via the top surface 200*c*. The open electrode 400 is not grounded and not to be connected to other electrodes disposed in the base member 200.

The fixing electrodes 500 (500*a*, 500*b*, and 500*c*) are arranged substantially parallel with the feeding electrode 300 and the open electrode 400 leaving spaces therebetween, and disposed at least on the bottom surface 200*a*. According to the present preferred embodiment, the base member 200 is connected on a substrate 800 of an object to be mounted (a circuit board of communication equipment, for example) by soldering using the bottom surface 200*a* as a mounting surface. In connecting the base member 200 to the substrate 800 of an object to be mounted (mounting substrate), the fixing electrode 500 functions as a base electrode for soldering. In addition, the fixing electrode 500 may be grounded or may not be grounded on the mounting substrate 800 depending on a circuit configuration.

According to the present preferred embodiment, the base member 200 is provided with a linear electrode 1000 with one end 1000*a* connected to the feeding electrode 300 and with the other end 1000*b* connected to the open electrode 400.

A loop radiant electrode 1100 extending from the feeding electrode 300 toward the open electrode 400 via the linear electrode 1000 is defined by the linear electrode 1000 and the feeding and open electrodes 300 and 400 disposed in the base member 200.

The linear electrode 1000 is provided with a short-cut electrode 1200 for short-circuiting the loop of the radiant electrode 1100. The short-cut electrode 1200 also defines the radiant electrode 1100, and the radiant electrode 1100 is thereby provided with a short loop extending from the feeding electrode 300 toward the open electrode 400 via the linear electrode 1000 and the short-cut electrode 1200. The loop extending from the feeding electrode 300 toward the open electrode 400 via the linear electrode 1000 without passing through the short-cut electrode 1200 is referred to as a basic loop in contrast with the short loop.

According to the present preferred embodiment, the basic loop of the radiant electrode 1100 has an electrical length so that the radiant electrode 1100 resonates at a predetermined basic-mode resonance frequency f1. A high-order-mode resonance frequency f2 that is higher than the basic-mode resonance frequency f1 is predetermined, and the short loop of the radiant electrode 1100 has an electrical length so that the radiant electrode 1100 resonates at the predetermined higher-order-mode resonance frequency f2.

According to the present preferred embodiment, in the vicinities of the feeding electrode 300 and open electrode 400, the fixing electrodes 500 are arranged adjacent thereto leaving spaces, respectively, and the feeding electrode 300 and the fixing electrodes 500, and the open electrode 400 and the fixing electrode 500 are combined with capacitances interposed therebetween. By adjusting the capacitances between the feeding electrode 300 and the fixing electrode 500 and between the open electrode 400 and the fixing electrode 500, electrical lengths of the basic loop and short loop are changed so as to enable the resonance frequency of the radiant electrode 1100 to be changed. In other words, the fixing electrode 500 functions as a frequency-adjusting electrode for adjusting the resonance frequency of the radiant electrode 1100. In comparing the cases that the fixing electrode 500 is grounded and it is not grounded, when spaces or opposing areas between the feeding electrode 300 and the fixing electrode 500 and between the open electrode 400 and the fixing electrode 500 are changed, the resonance frequency of the radiant electrode 1100 is changed by a greater amount in the grounded case of the fixing electrode 500 than in the nongrounded case.

By changing the length of the linear electrode 1000 between one end thereof and the other end, the length of the basic loop of the radiant electrode 1100 is changed so as to change the electrical length of the basic loop of the radiant electrode 1100, thereby changing the basic-mode resonance frequency f1 of the radiant electrode 1100. Also, by changing the arrangement and the length of the short-cut electrode 1200, the length of the short loop of the radiant electrode 1100 is changed so as to change the electrical length of the short loop, thereby changing the higher-order-mode resonance frequency f2 of the radiant electrode 1100.

In such a manner, the capacitance between the feeding electrode 300 and the fixing electrode 500, the capacitance between the open electrode 400 and the fixing electrode 500, the length of the linear electrode 1000, and the arrangement and the length of the short-cut electrode 1200 are involved in the electrical lengths of the basic loop and short loop of the radiant electrode 1100, i.e., the resonance frequencies f1 and f2. Therefore, these factors are designed such that the radiant electrode 1100 has the established basic-mode resonance frequency f1 and higher-order-mode resonance frequency f2.

In the surface-mounted antenna 100 according to the present preferred embodiment, the feeding end 300*a* of the feeding electrode 300 is connected to the signal supply source 700 by mounting the surface-mounted antenna 100 on the mounting substrate 800 following the set-up procedure. In supplying a signal with the basic-mode resonance frequency f1 to the feeding electrode 300 from the signal supply source 700, for example, a major portion of the signal turns on electricity toward the open electrode 400 from the feeding electrode 300 by the route of the basic loop, so that the radiant electrode 1100 resonates at the basic-mode resonance frequency f1 so as to perform the basic-mode antenna operation.

Also, in supplying a signal with the higher-order-mode resonance frequency f2 to the feeding electrode 300 from the signal supply source 700, a major portion of the signal turns on electricity toward the open electrode 400 from the feeding electrode 300 by the route of the short loop, so that the radiant electrode 1100 resonates at the higher-order-mode resonance frequency f2 so as to perform the higher-order-mode antenna operation.

According to the present preferred embodiment, the feeding electrode 300 and the open electrode 400 are arranged adjacent to each with a space provided therebetween, and the feeding electrode 300 and the open electrode 400 are combined with a capacitance interposing therebetween. The capacitance between the feeding electrode 300 and the open electrode 400 is largely involved in the gain in the higher-order-mode antenna operation. Therefore, according to the present preferred embodiment, the space between the feeding electrode 300 and the open electrode 400 and the length of the portion, in which the feeding electrode 300 and the open electrode 400 are arranged adjacent to each other, are established so that the capacitance between the feeding electrode 300 and the open electrode 400 has an appropriate value for obtaining the excellent higher-order-mode gain. Thereby, the gain in the higher-order-mode antenna operation is greatly improved, enabling the practical signal transmitting or receiving utilizing the higher-order-mode resonance of the radiant electrode 1100 to be achieved.

In addition, on the signal-transmitting route between the surface-mounted antenna 100 and the signal supply source 700, a signal-frequency switching circuit may be provided. However, the description of the signal-frequency switching circuit is omitted in the present preferred embodiment.

By the configuration as described above, the surface-mounted antenna 100 according to the present preferred embodiment can transmit or receive signals with plurality of different frequency bands.

Figure 4:
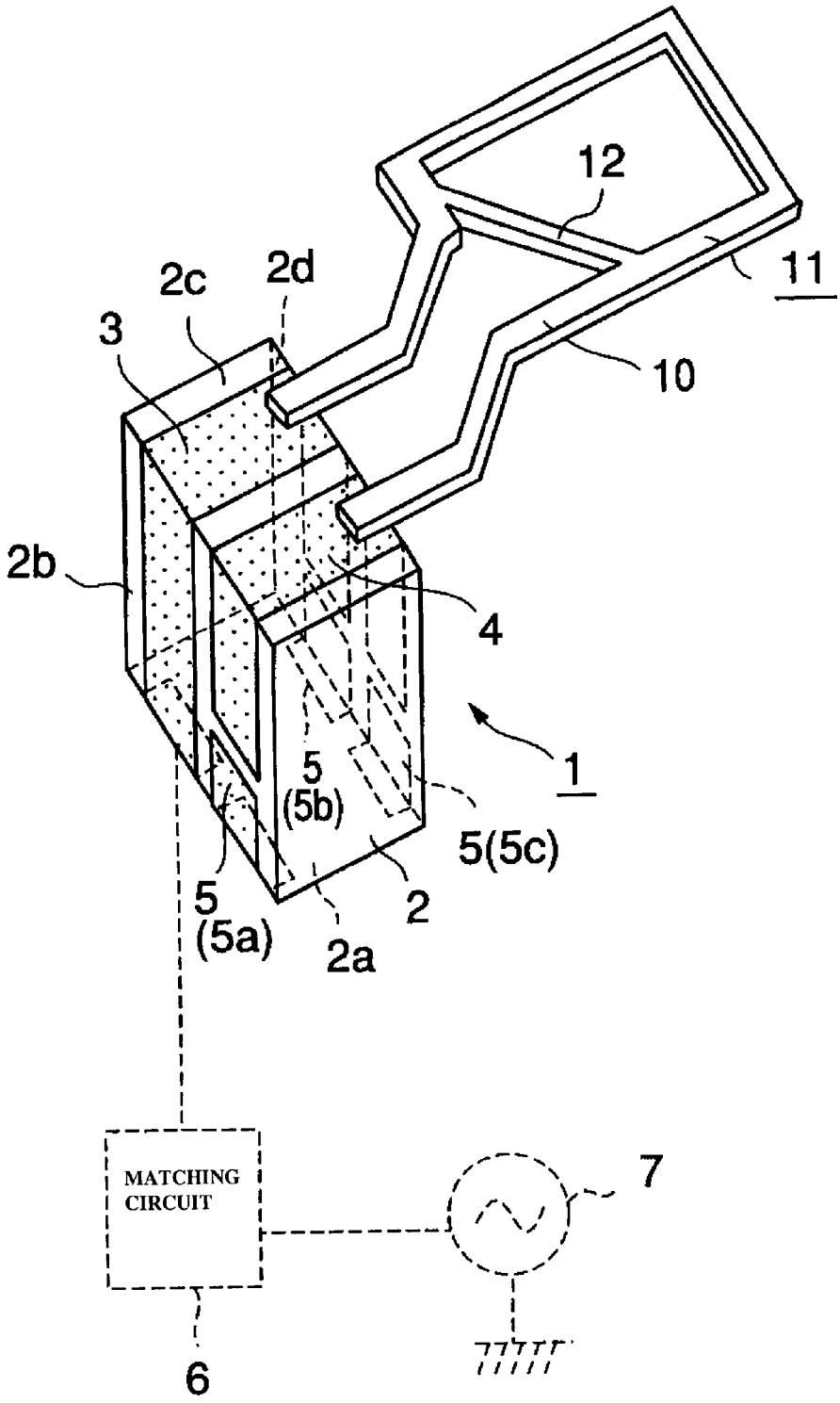
FIG. 4 is a model view of a surface-mounted antenna according to another preferred embodiment of the present invention.

Various modifications of the present preferred embodiment of the present invention may be made within the scope of the present invention. For example, the electrode 1000 and short-cut electrode 1200, which are attached to the base member 200 may be made of a narrow metallic plate as shown in FIG. 4. In this case, the electrode 1000 and the short-cut electrode 1200 are easily manufactured by punching a metallic plate using a die, so that the productivity of the electrodes 1000 and 1200 can be improved.

Figure 5A:
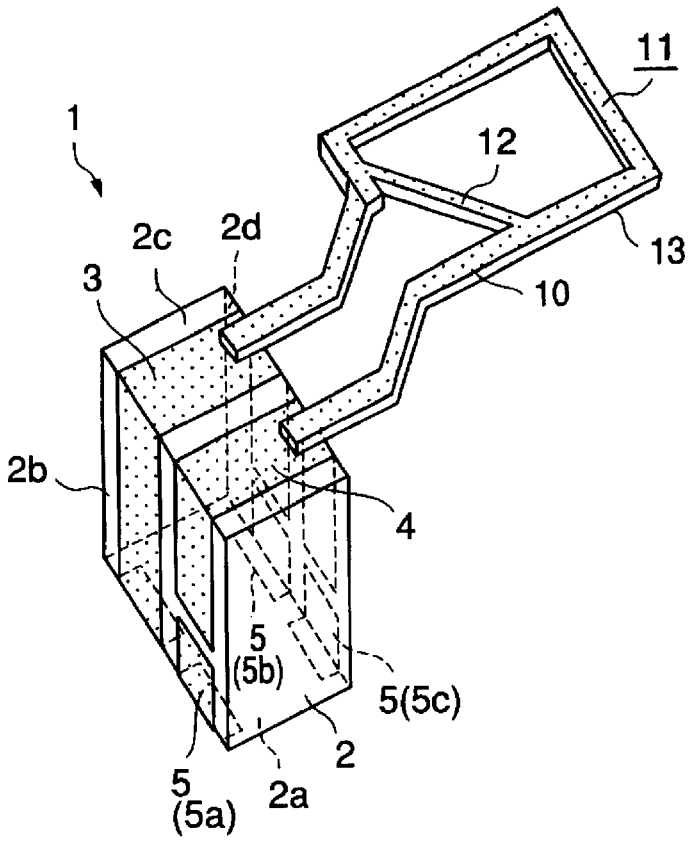
FIGS. 5A and 5B are model views for respectively showing a surface-mounted antenna according to another embodiment preferred embodiment of the present invention.
Figure 5B:
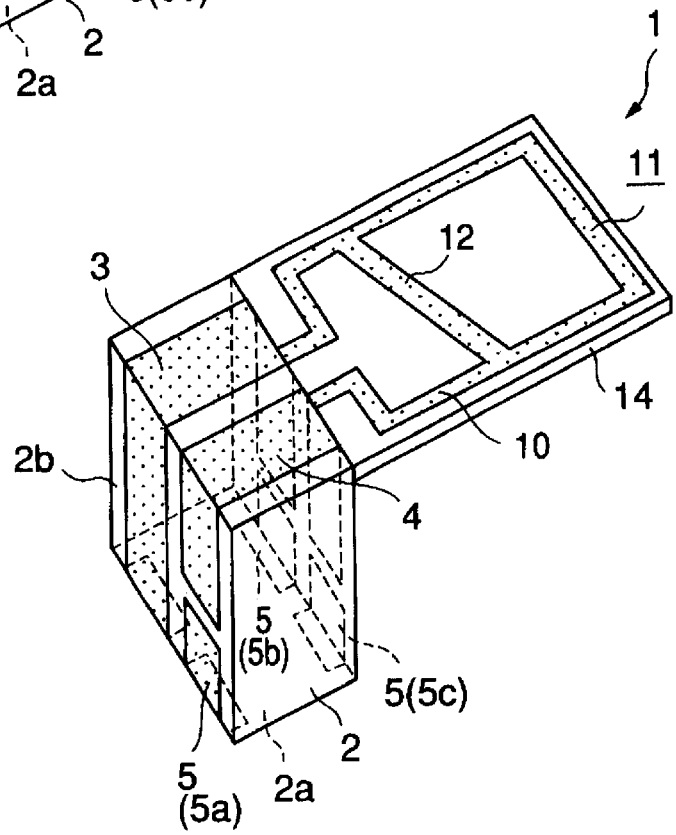
Figure 6:
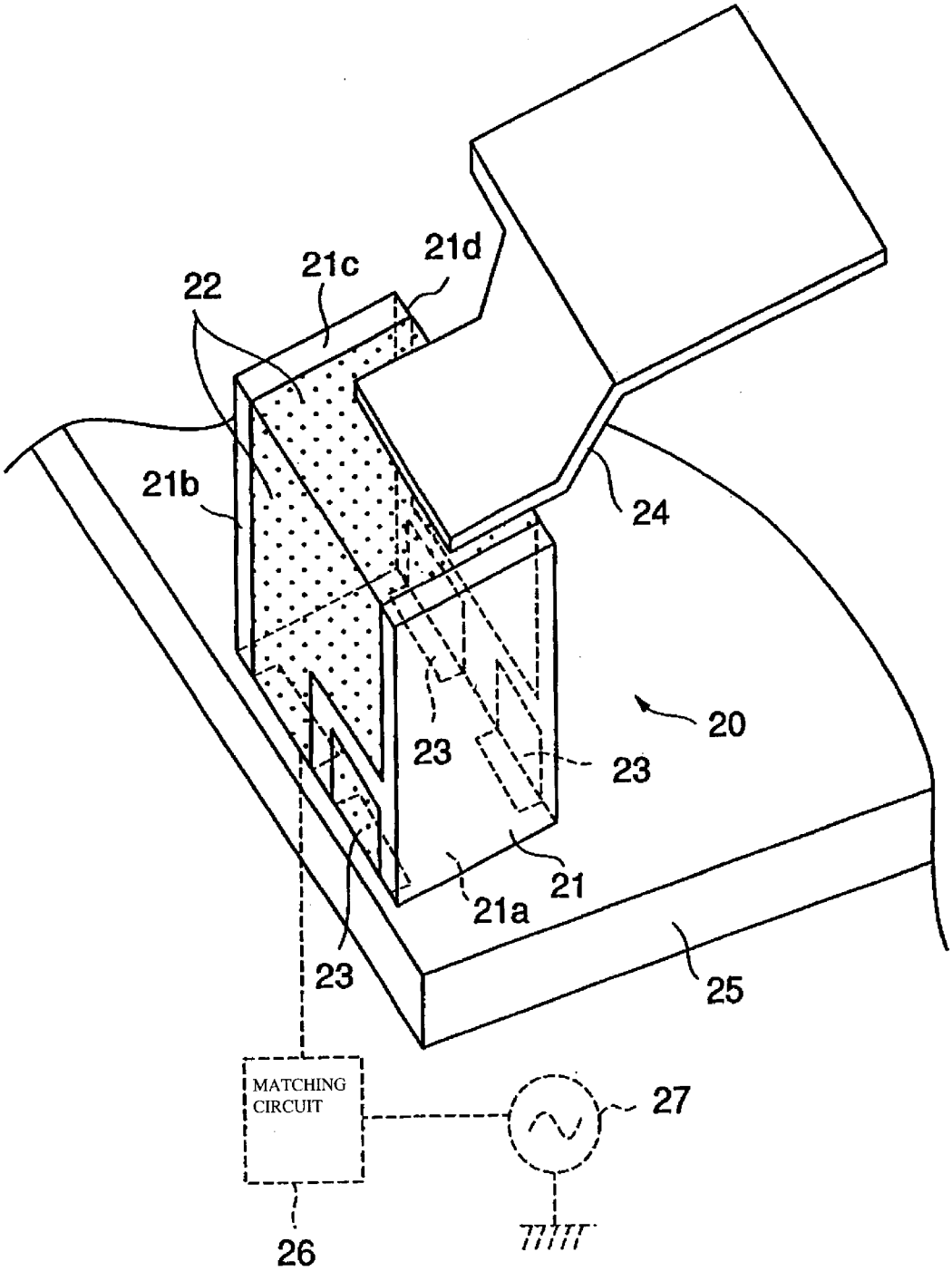
Fig. 6 PRIOR ART
FIG. 6 is a schematic perspective view of a conventional surface-mounted antenna.

Also, one of the electrode 1000 and the short-cut electrode 1200 may be made of metallic wire while the other may be made of a narrow metallic plate. As shown in FIG. 5A, the electrode 1000 and the short-cut electrode 1200 may be made by forming a conductive member on the surface of a narrow plate-like base member 1300 (dielectric base member, for example). Furthermore, as shown in FIG. 5B, the electrode 1000 and the short-cut electrode 1200 may be made by forming a conductive pattern on a flat-plate base member 1400 made of a dielectric material.

Furthermore, the electrode 1000 attached to the base member 200 is preferably substantially rectangular loop-shaped according to the present preferred embodiment. However, the shape of the electrode 1000 is not particularly limited.

Also, three fixing electrodes 500 are preferably provided according to the present preferred embodiment. However, the number is not limited thereto, and one, or four or more fixing electrodes 500 may be provided. As a structure that the base member 200 is connected to the mounting substrate 800 without using solder, the fixing electrodes 500 may be omitted if the fixing electrodes 500 as a base electrode for soldering is unnecessary.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. An antenna comprising:

an electrode for performing an antenna operation, a first end of the electrode defining a feeding end for receiving a signal from a signal supply and a second end of the electrode defining an open end;

wherein the feeding end and the open end are arranged adjacent to each other with a space provided therebetween, the electrode has a loop and a short-cut electrode is arranged to short-cut the a loop of the electrode.

2. An antenna according to claim 1, wherein the loop of the electrode extends from the feeding end toward the open end and has an electrical length corresponding to a predetermined basic-mode resonance frequency and a short loop extending from the feeding end of the electrode toward the open end via the short-cut electrode has an electrical length corresponding to a higher-order-mode resonance frequency higher than the basic-mode resonance frequency, and the electrode performs a basic-mode antenna operation and a higher-order-mode antenna operation.

3. An antenna according to claim 1, further comprising a base member including a feeding electrode to be connected to a signal supply source, and an open electrode arranged substantially parallel to the feeding electrode leaving a space in a floated state from a ground, wherein said electrode is attached to the base member with a first end connected to the feeding electrode and a second end connected to the open electrode.

4. An antenna according to claim 3, wherein a loop-shaped radiant electrode extending from the feeding electrode toward the open electrode via the electrode is defined by the feeding electrode, the electrode, and the open electrode.

5. An antenna according to claim 3, wherein the base member is provided with a frequency-adjusting electrode arranged adjacent to one of the feeding electrode and the open electrode leaving a space for adjusting the resonance frequency of the radiant electrode by being combined with the adjacent electrode via a capacitance generated therebetween.

6. An antenna according to claim 1, wherein the electrode is linear shaped.

7. An antenna according to claim 1, wherein the electrode is plate-shaped.

8. A communication apparatus comprising an antenna according to claim 1.

9. A loop antenna comprising:

a radiant electrode for performing an antenna operation, a first end of the radiant electrode being a feeding end for receiving a signal from a signal supply and a second end of the radiant electrode being an open end;

wherein the radiant electrode has a substantially loop shape, in which the feeding end and the open end are arranged adjacent to each other with a space provided therebetween, and the radiant electrode is provided with a short-cut electrode short-cutting a loop of the radiant electrode.

10. An antenna according to claim 9, wherein the loop of the radiant electrode extending from the feeding end toward the open end has an electrical length corresponding to a predetermined basic-mode resonance frequency and a short loop extending from the feeding end of the radiant electrode toward the open end via the short-cut electrode has an electrical length corresponding to a higher-order-mode resonance frequency higher than the basic-mode resonance frequency, and the radiant electrode performs a basic-mode antenna operation and a higher-order-mode antenna operation.

11. An antenna according to claim 9, wherein the radiant electrode is linear shaped.

12. An antenna according to claim 9, wherein the radiant electrode is plate-shaped.

13. A communication apparatus comprising a loop antenna according to claim 9.

14. A surface-mounted antenna comprising:

a base member including:

a feeding electrode to be connected to a signal supply source;

an open electrode arranged substantially parallel to the feeding electrode leaving a space in a floated state from a ground; and an electrode attached to the base member with a first end connected to the feeding electrode and a second end connected to the open electrode;

wherein a loop-shaped radiant electrode extending from the feeding electrode toward the open electrode via the electrode is defined by the feeding electrode, the electrode, and the open electrode, and the electrode is provided with a short-cut electrode for short-cutting a loop of the radiant electrode.

15. An antenna according to claim 14, wherein the loop of the radiant electrode extending from the feeding electrode toward the open electrode via the electrode has an electrical length corresponding to a predetermined basic-mode resonance frequency and a short loop extending from the feeding electrode of the radiant electrode toward the open electrode via the electrode and the short-cut electrode has an electrical length corresponding to a predetermined high-order-mode resonance frequency higher than the basic-mode resonance frequency so that the radiant electrode performs a basic-mode antenna operation and a higher-order-mode antenna operation.

16. An antenna according to claim 14, wherein the base member is provided with a frequency-adjusting electrode arranged adjacent to one of the feeding electrode and the open electrode leaving a space for adjusting the resonance frequency of the radiant electrode by being combined with the adjacent electrode via a capacitance generated therebetween.

17. An antenna according to claim 14, wherein the electrode is linear shaped.

18. An antenna according to claim 14, wherein the electrode is plate-shaped.

19. A communication apparatus comprising a surface-mounted antenna according to claim 14.

* * * * *

UNITED STATES PATENT AND TRADEMARK OFFICE

CERTIFICATE OF CORRECTION

PATENT NO. : 6,680,708 B2
DATED : January 20, 2004
INVENTOR(S) : Kazuhisa Yamaki It is certified that error appears in the above-identified patent and that said Letters Patent is hereby corrected as shown below:

Title page,
Item [30], Foreign Application Priority Data, should read:
-- Oct. 12, 2001 (JP) 2001-315567
Oct. 22, 2001 (JP) 2001-323442 --

Signed and Sealed this

Sixth Day of April, 2004

JON W. DUDAS
*Acting Director of the United States Patent and Trademark Office*